US009297340B2

(12) United States Patent
Pearce et al.

(10) Patent No.: US 9,297,340 B2
(45) Date of Patent: Mar. 29, 2016

(54) METHOD AND SYSTEM FOR FUEL VAPOR CONTROL

(71) Applicant: Ford Global Technologies, LLC, Dearborn, MI (US)

(72) Inventors: Russell Randall Pearce, Ann Arbor, MI (US); Mark W. Peters, Wolverine Lake, MI (US); Aed M. Dudar, Canton, MI (US); Dennis Seung-Man Yang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 221 days.

(21) Appl. No.: 14/034,424

(22) Filed: Sep. 23, 2013

(65) Prior Publication Data

US 2015/0083087 A1 Mar. 26, 2015

(51) Int. Cl.
*F02M 25/08* (2006.01)

(52) U.S. Cl.
CPC ..... *F02M 25/0809* (2013.01)

(58) Field of Classification Search
CPC ..... F02M 25/08; F02M 25/0809; F02M 25/0836; F02M 25/0854
USPC ..... 123/516–520; 701/102, 114, 115; 73/114.41, 114.57
See application file for complete search history.

(56) References Cited

U.S. PATENT DOCUMENTS

| | | | | |
|---|---|---|---|---|
| 5,635,630 | A * | 6/1997 | Dawson et al. | 73/40.5 R |
| 7,373,930 | B1 | 5/2008 | Hadre | |
| 8,074,627 | B2 | 12/2011 | Siddiqui | |
| 8,342,157 | B2 | 1/2013 | Der Manuelian et al. | |
| 8,353,273 | B2 | 1/2013 | McLain et al. | |
| 2004/0089064 | A1 * | 5/2004 | Kidokoro et al. | 73/118.1 |
| 2004/0200460 | A1 * | 10/2004 | Mitani et al. | 123/520 |
| 2005/0022588 | A1 * | 2/2005 | Hayakawa et al. | 73/118.1 |
| 2006/0016253 | A1 * | 1/2006 | Kobayashi et al. | 73/118.1 |
| 2007/0033987 | A1 | 2/2007 | Herzog et al. | |
| 2007/0137622 | A1 * | 6/2007 | Koyama | 123/520 |
| 2009/0043476 | A1 * | 2/2009 | Saito et al. | 701/102 |
| 2011/0127284 | A1 | 6/2011 | Schoenfuss | |
| 2011/0315127 | A1 | 12/2011 | Jackson et al. | |
| 2012/0130596 | A1 * | 5/2012 | Ooiwa | 701/45 |
| 2012/0132179 | A1 * | 5/2012 | Kobayashi et al. | 123/518 |
| 2012/0211087 | A1 | 8/2012 | Dudar et al. | |
| 2013/0008414 | A1 * | 1/2013 | Matsunaga et al. | 123/519 |
| 2013/0096757 | A1 * | 4/2013 | Fukui et al. | 701/22 |
| 2013/0199504 | A1 * | 8/2013 | Takeishi et al. | 123/520 |
| 2013/0253799 | A1 * | 9/2013 | Peters et al. | 701/102 |

OTHER PUBLICATIONS

Anonymous, "EONV Robustness and Isolation Method for Start/Stop Programs," IPCOM No. 000238494D, Published Aug. 28, 2014, 2 pages.

(Continued)

*Primary Examiner* — John Kwon
*Assistant Examiner* — Johnny H Hoang
(74) *Attorney, Agent, or Firm* — James Dottavio; Alleman Hall McCoy Russell & Tuttle LLP

(57) ABSTRACT

Methods and systems are provided for identifying leaks on each of a fuel tank and a canister side of a fuel system using a single leak check module. A position of a switching valve coupled in the vapor line of the fuel system is adjusted to selectively couple the leak check module to either the fuel tank or the canister. Leak is detected based on a change in pressure at a reference orifice of the leak check module following applying of vacuum from a vacuum pump.

19 Claims, 5 Drawing Sheets

(56) References Cited

OTHER PUBLICATIONS

Anonymous, "An Onboard Method to Mitigate Very Small Evap Leaks in Start/Stop and HEV Vehicles," IPCOM No. 000240776, Published Feb. 27, 2015, 2 pages.

Anonymous, "An EVAP System With Hardware to Pinpoint Canister Side Leak Locations," IPCOM No. 000242002, Published Jun. 12, 2015, 2 pages.

* cited by examiner

METHOD AND SYSTEM FOR FUEL VAPOR CONTROL

FIELD

The present application relates to fuel system leak detection in vehicles, such as hybrid vehicles.

BACKGROUND AND SUMMARY

Vehicle emission control systems may be configured to store fuel vapors from fuel tank refueling and diurnal engine operations, and then purge the stored vapors during a subsequent engine operation. In hybrid vehicles, shorter engine operation times can lead to insufficient purging of fuel vapors from the vehicle's emission control system. To address this issue, hybrid vehicles may include a fuel tank isolation valve (FTIV) between a fuel tank and a hydrocarbon canister of the emission system to limit the amount of fuel vapors absorbed in the canister. In an effort to meet stringent federal emissions regulations, emission control systems may need to be intermittently diagnosed for the presence of leaks that could release fuel vapors to the atmosphere. This includes diagnosis of leaks on the fuel tank side as well as the canister side of the FTIV. In addition, the mandated orifice size of leaks to be diagnosed on the fuel tank side often vary from the mandated orifice size of leaks to be diagnosed on the canister side. For example, emission control systems may need to be able to detect a 0.020" orifice on the canister side while also being able to detect a 0.010" orifice on the fuel tank side.

One example approach for fuel system leak detection is shown by Siddiqui et al. in U.S. Pat. No. 8,074,627. Therein, fuel tank integrity is tested with a fuel tank isolation valve (FTIV) closed by operating a fuel pump to withdraw fuel. A change in fuel tank vacuum is them compared to a threshold to identify fuel tank leakage.

However, the inventors herein have recognized that the approach of Siddiqui et al. identifies a fuel system leak but may not be able to distinguish a leak on the fuel tank side of the FTIV from a leak on the canister side of the FTIV. In addition, the approach of Siddiqui may not be able to distinguish leaks of a first size on a fuel tank side from leaks of different size on the canister side. As such, this may render the system of Siddiqui emissions non-compliant. While the system of Siddiqui may be modified to include reference orifices of different sizes or dedicated leak check modules on both sides of the FTIV, to thereby distinguish fuel tank side leaks from canister side leaks, this may add additional cost and complexity to the system.

Thus in one example, some of the above issues may be addressed by a method for an engine, comprising: indicating leakage on a canister side of a fuel system based on a first change in pressure at a reference orifice following applying of vacuum to the fuel system with an isolation valve closed; and indicating leakage on a fuel tank side of the fuel system based on a second change in pressure at the reference orifice following applying of vacuum to the fuel system with the isolation valve open. In this way, the same leak check module and reference orifice may be used to detect different sized leaks on either side of a fuel system.

For example, a fuel system coupled in a hybrid vehicle may be configured with an evaporative leak check module (ELCM) including a vacuum pump, a reference orifice, and a pressure sensor. The leak check module may be coupled into a vapor line of the fuel system via a three-way switching valve. In particular, the leak check module may be coupled to a fuel system canister along a vent via the switching valve, the valve further plumbed so as to be selectively coupled to the fuel tank vapor line. The fuel tank vapor line may couple the fuel tank to the canister via a fuel tank isolation valve (FTIV) so that refueling vapors generated in the fuel tank can be stored in the canister and diurnal vapors can be held in the fuel tank. A position of the switching valve may be adjusted during leak tests so as to selectively apply vacuum from the ELCM on either the canister side or the fuel tank side of the fuel system. For example, the ELCM may be operated with the switching valve in a first position, and with the FTIV closed, so as to apply vacuum from the ELCM onto the canister side. During this mode, the ELCM may be directly communicating with the canister and not with the fuel tank. A first change in pressure may be monitored at the reference orifice following the applying of vacuum. If the first change in pressure is higher than a first threshold, a fuel system leak on the canister side may be confirmed. The ELCM may then be operated with the switching valve in a second position, and with the FTIV open. During this mode, the ELCM may be directly communicating with the fuel tank and not with the canister. A second change in pressure may be monitored at the reference orifice of the leak check module following the applying of vacuum. If the second change in pressure is higher than a second threshold, a fuel system leak on the fuel tank side may be confirmed.

In this way, each of a fuel tank side and a canister side of a fuel system may be diagnosed using the same leak check module, including the same vacuum pump and reference orifice. By adjusting the position of a switching valve coupling an inlet of the leak check module with the vapor line between the fuel tank and canister, the leak check module can be selectively coupled to only the canister or only the fuel tank. This reduces the need for additional components to diagnose and distinguish leaks on both sides of a fuel system. By comparing the change in pressure estimated on either side of the fuel system to different thresholds, the same reference orifice can be used to diagnose leaks of different sizes on the canister side relative to the fuel tank side. The same may alternatively be achieved by applying a different amount of vacuum on the canister when the fuel tank is isolated, as compared to the amount of vacuum applied on the fuel tank when the canister side is isolated. In this way, leaks of different sizes on different sides of a fuel system may be better identified and distinguished. Overall, emissions compliance may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
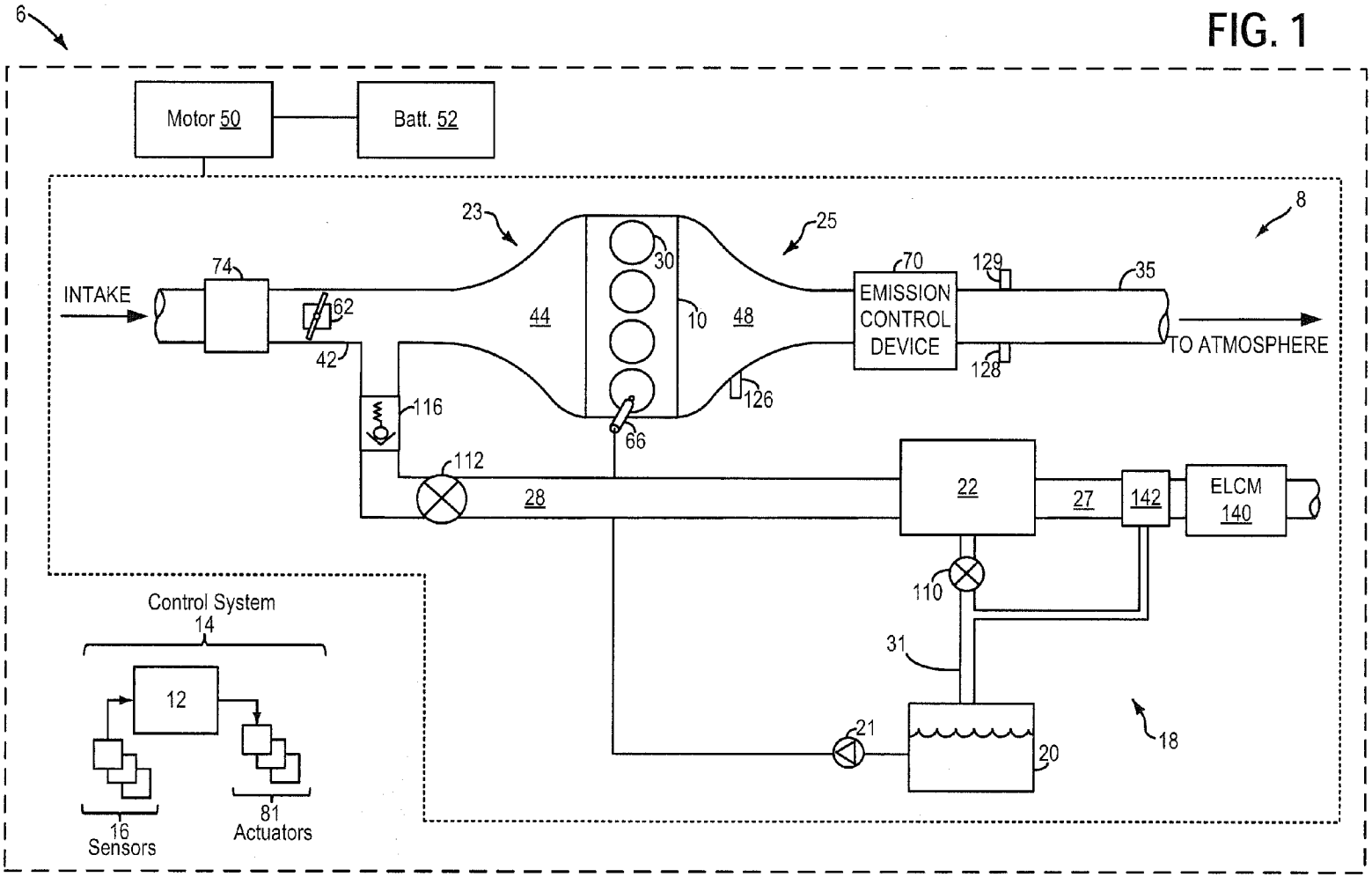
FIG. 1 shows a schematic depiction of an example fuel system coupled in a hybrid electric vehicle system.
Figure 2:
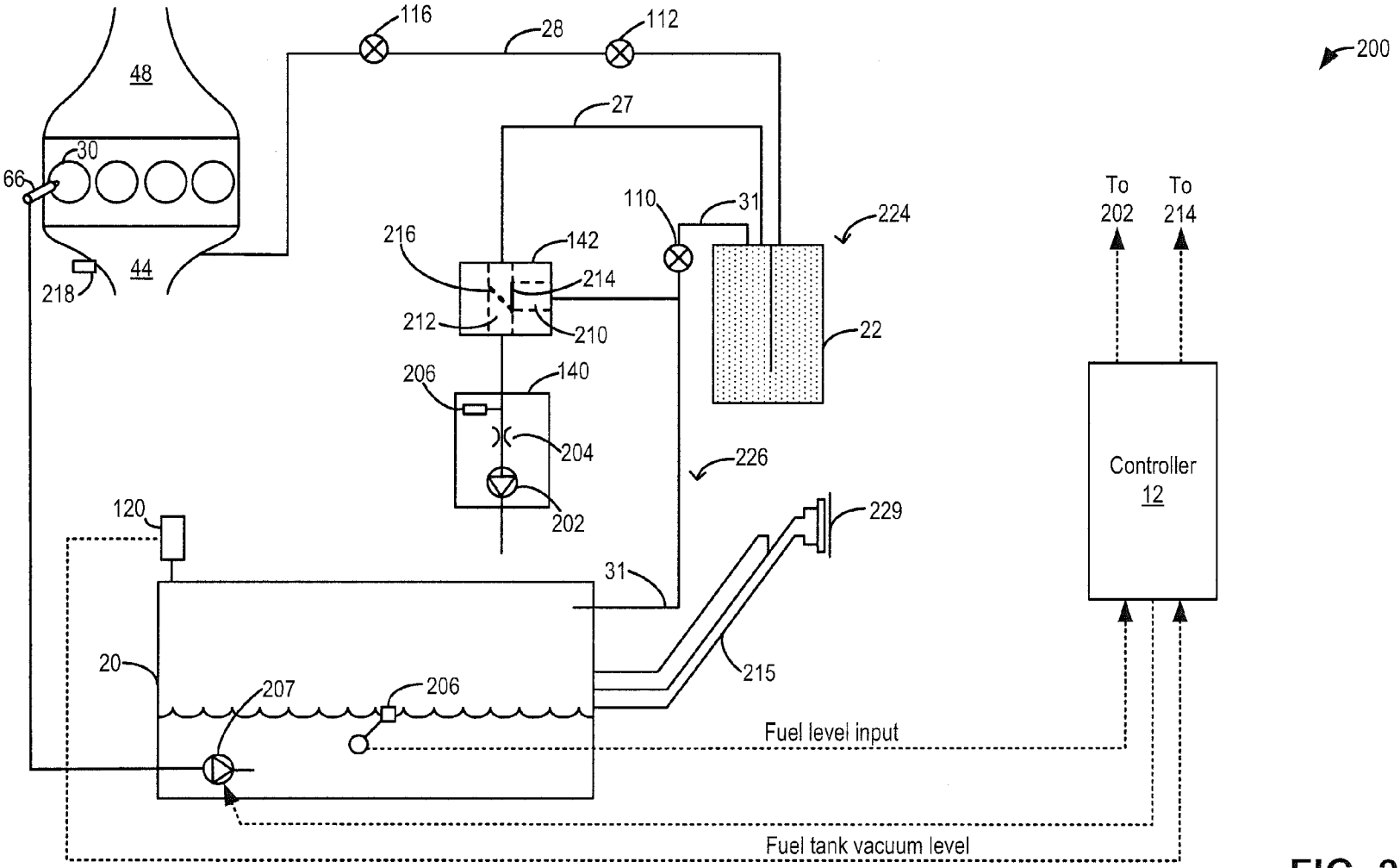
FIG. 2 shows a detailed embodiment of the fuel system of FIG. 1.
Figure 3:
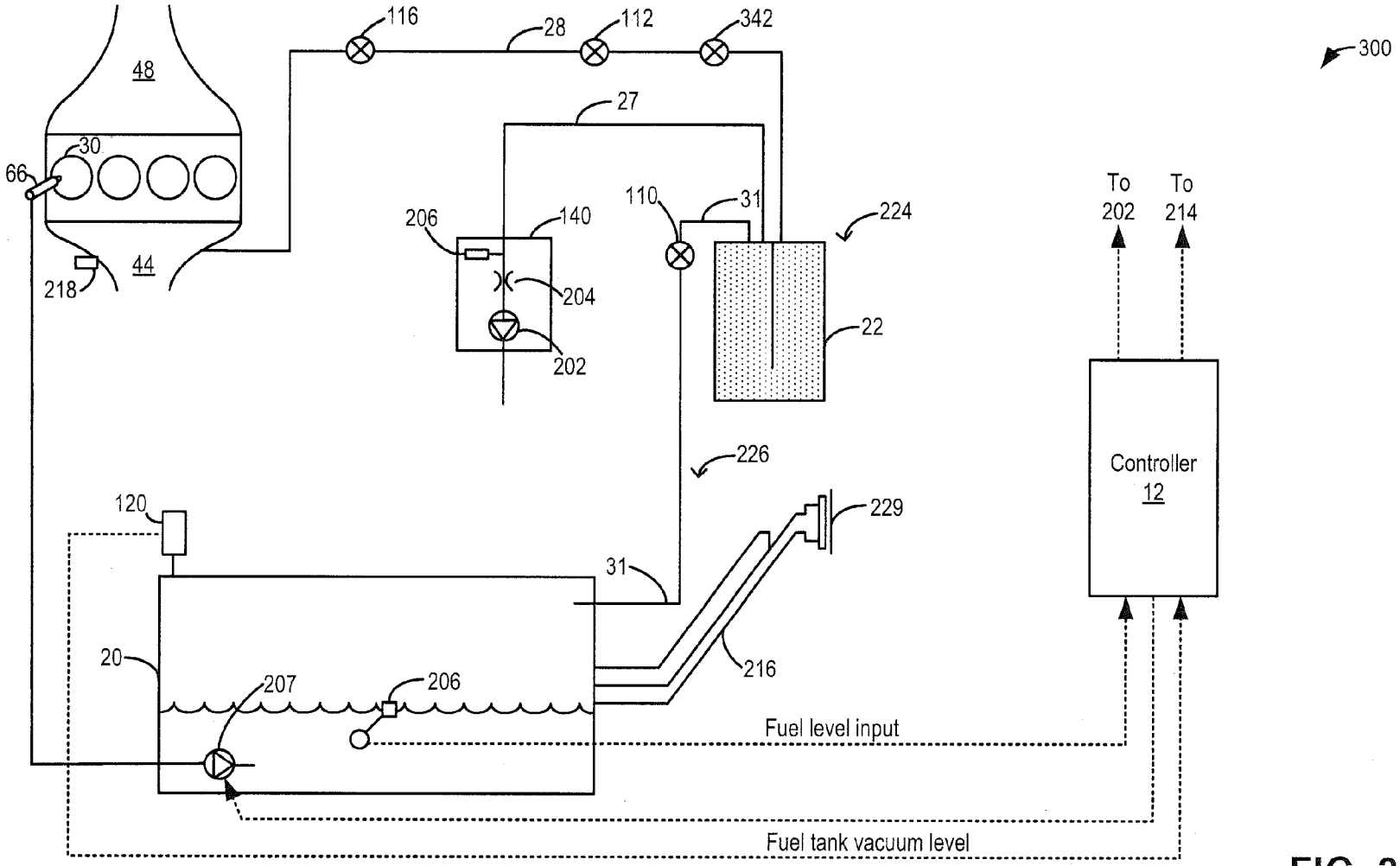
FIG. 3 shows another example embodiment of the fuel system of FIG. 1.

The following description relates to systems and methods for performing leak detection on both a canister side and fuel tank side of a fuel system coupled in a hybrid electric vehicle such as the fuel system of FIG. 2 in the engine system of FIG. 1. A three-way switching valve may be positioned in a vapor line of the fuel system so as to selectively couple an evaporative leak check module (ELCM) to either the canister side or fuel tank side of the fuel system, as shown at FIG. 2. An engine controller may be configured to perform a control routine, such as the example routine of FIG. 4, to adjust the position of the switching valve and the opening of a fuel system isolation valve to selectively apply vacuum from the ELCM to either the fuel tank or the canister. In alternate examples, the switching valve may be replaced with a latching valve having a seal, as shown at FIG. 3. Based on a change in pressure at a reference orifice following the applying of vacuum, the presence of a leak may be determined. By comparing the change in pressure on either side to different thresholds, differences in pressure behavior on either side of the fuel system can be accounted for. Example leak tests are shown with reference to FIG. 5. In this way, leak detection accuracy is improved.

FIG. 1 shows a schematic depiction of a hybrid vehicle system 6 that can derive propulsion power from engine system 8 and/or an on-board energy storage device, such as a battery system 52. An energy conversion device, such as a motor/generator 50, may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes a throttle 62 fluidly coupled to the engine intake manifold 44 via an intake passage 42. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated at FIG. 2.

In some embodiments, engine intake 23 may further include a boosting device, such as a compressor 74. Compressor 74 may be configured to draw in intake air at atmospheric air pressure and boost it to a higher pressure. As such, the boosting device may be a compressor of a turbocharger, where the boosted air is introduced pre-throttle, or the compressor of a supercharger, where the throttle is positioned before the boosting device. Using the boosted intake air, a boosted engine operation may be performed.

Engine system 8 may be coupled to a fuel system 18. Fuel system 18 may include a fuel tank 20 coupled to a fuel pump system 21 and one or more (one depicted in the present example) fuel vapor canisters 22. Fuel tank 20 may hold a plurality of fuel blends, including fuel with a range of alcohol concentrations, such as various gasoline-ethanol blends, including E10, E85, gasoline, etc., and combinations thereof. Fuel pump system 21 may include one or more pumps for pressurizing fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, described further below, via conduit 31, before being purged to the engine intake 23.

Fuel vapor canisters 22 may be filled with an appropriate adsorbent, for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor recovery system 22 may be purged to engine intake 23 via purge line 28 by opening canister purge valve 112.

Canister 22 may be further coupled to a vent 27 which may route gases out of the canister 22 to the atmosphere when storing, or trapping, fuel vapors from fuel tank 20. Vent 27 may also allow fresh air to be drawn into canister 22 when purging stored fuel vapors to engine intake 23 via purge line 28 and purge valve 112. In some examples, a canister check valve 116 may be optionally included in purge line 28 to prevent (boosted) intake manifold pressure from flowing gases into the purge line in the reverse direction. While this example shows vent 27 communicating with fresh, unheated air, various modifications may also be used. A detailed configuration of fuel system 18 is described at FIGS. 2-3, including various additional components that may be included in the intake, and exhaust.

As such, hybrid vehicle system 6 may have reduced engine operation times due to the vehicle being powered by engine system 8 during some conditions, and by energy storage device 52 or motor 50 under other conditions. While the reduced engine operation times reduce overall carbon emissions from the vehicle, they may also lead to insufficient purging of fuel vapors from the vehicle's emission control system. To address this, fuel tank 20 may be designed to withstand high fuel tank pressures. For example, fuel tank 20 may be constructed of material that is able to structurally withstand high fuel tank pressures (such as fuel tank pressures that are higher than a threshold and below atmospheric pressure). Additionally, a fuel tank isolation valve (FTIV) 110 may be included in conduit 31 such that fuel tank 20 is coupled to the canister of fuel vapor recovery system 22 via the valve. Isolation valve 110 may be a solenoid valve wherein operation of the valve may be regulated by adjusting a driving signal to (or pulse width of) the dedicated solenoid (not shown).

Isolation valve 110 may normally be kept closed to limit the amount of fuel vapors absorbed in the canister from the fuel tank. The normally closed isolation valve thereby separates storage of refueling vapors from the storage of diurnal vapors. The isolation valve is opened during refueling to allow refueling vapors to be directed to the canister. As another example, the normally closed isolation valve may be opened during selected purging conditions, such as when the fuel tank pressure is higher than a threshold (e.g., a mechanical pressure limit of the fuel tank above which the fuel tank and other fuel system components may incur mechanical damage), to release fuel vapors into the canister and maintain the fuel tank pressure below pressure limits. The isolation valve 110 may also be closed during leak detection routines to isolate the fuel tank from the engine intake.

One or more pressure sensors (FIGS. 2-3) may be coupled to the fuel tank, upstream and/or downstream of isolation valve 110, to estimate a fuel tank pressure, or fuel tank vacuum level. One or more oxygen sensors (FIGS. 2-3) may be coupled to the canister (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Leak detection routines may be intermittently performed on fuel system 18 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 140 communicatively coupled to controller 12. ELCM 140 may be coupled in vent 27, between canister 22 and the atmosphere. As elaborated at FIG. 2, ELCM 140 may include a vacuum pump for applying negative pressure to the fuel system when administering a leak test. ELCM may further include a reference orifice and a pressure sensor. Following the applying of vacuum to the fuel system, a change in pressure at the reference orifice (e.g., an absolute change or a rate of change) may be monitored and compared to a threshold. Based on the comparison, a fuel system leak may be diagnosed.

As such, emission regulations mandate the ability to detect and distinguish leaks on both a fuel tank side and a canister side of the fuel system. In addition, the size of leaks to be detected on either side may differ. In one example, the ELCM is required to be able to detect smaller leaks (e.g., of 0.010" orifice size) on the fuel tank side while detecting larger leaks (e.g., of 0.020" orifice size) on the canister side. To enable leak diagnosis on both sides of the fuel system (on either side of FTIV 110), ELCM 140 may be coupled to canister 22 among vent 27 via a switching valve 142. In addition, switching valve 142 may also be coupled to fuel tank 20, along conduit 31, at a location between FTIV 110 and fuel tank 20. As elaborated at FIG. 2, switching valve 142 may be a three-way valve coupling an inlet of ELCM 140 to one of canister 22 and fuel tank 20. For example, with FTIV 110 closed, switching valve 142 may be shifted to a first position coupling the ELCM directly to the canister. Herein, the fuel tank may be isolated from the ELCM and the canister side may be diagnosed for leaks by applying vacuum from the vacuum pump onto the canister. As another example, with FTIV 110 open, switching valve 142 may be shifted to a second position coupling the ELCM directly to the fuel tank. Herein, the fuel tank side may be diagnosed for leaks by applying vacuum from the vacuum pump onto the fuel tank. A change in pressure may then be monitored by a pressure sensor of the ELCM at a reference orifice.

As described herein, the leak tests performed may be vacuum-based or negative pressure leak tests. During the negative pressure leak test, canister purge valve 112 and canister vent valve 114 may be kept closed to isolate the fuel system. Vacuum may be applied to the fuel tank or canister side of the fuel system until a threshold vacuum level has been reached. Based on a rate of pressure bleed-up (to atmospheric pressure) and a final stabilized fuel system pressure, the presence of a fuel system leak may be determined. For example, in response to a bleed-up rate that is faster than a threshold rate, a leak may be determined.

It will be appreciated that in alternate examples, the leak test may be a positive pressure leak test wherein the pump of the ELCM may be a positive pressure pump. Therein, a positive pressure may be applied to the fuel tank or canister side of the fuel system until a threshold pressure level has been reached. Based on a rate of pressure bleed-down to atmospheric pressure and a final stabilized fuel system pressure, the presence of a fuel system leak may be determined.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 6, as discussed in more detail in FIG. 2. As another example, the actuators may include fuel injector 66, isolation valve 110, purge valve 112, switching valve 142, throttle 62, and the vacuum pump of ELCM 140. The control system 14 may include a controller 12. The controller may receive input data from the various sensors, process the input data, and trigger the actuators in response to the processed input data based on instruction or code programmed therein corresponding to one or more routines. An example control routine is described herein with regard to FIG. 4.

FIG. 2 shows an example embodiment 200 of fuel system 18. FIG. 3 shows another example embodiment 300 of fuel system 18. As such, vehicle system components previously introduced at FIG. 1 are numbered similarly at FIGS. 2-3 and not reintroduced.

Turning to example embodiment 200 of FIG. 2, canister 22 may receive fuel vapors from fuel tank 20 through conduit 31. During regular engine operation, isolation valve 110 may be kept closed to limit the amount of diurnal vapors directed to canister 22 from fuel tank 20. During refueling operations, and selected purging conditions, isolation valve 110 may be temporarily opened, e.g., for a duration, to direct fuel vapors from the fuel tank to canister 22. While the depicted example shows isolation valve 110 positioned along conduit 31, in alternate embodiments, the isolation valve may be mounted on fuel tank 20.

One or more pressure sensors may be coupled to fuel tank 20 for estimating a fuel tank pressure or vacuum level. While the depicted example shows pressure sensor 120 coupled to fuel tank 20, in alternate embodiments, the pressure sensor may be coupled between the fuel tank and isolation valve 110. In still other embodiments, a first pressure sensor may be positioned upstream of the isolation valve, while a second pressure sensor is positioned downstream of the isolation valve, to provide an estimate of a pressure difference across the valve.

A fuel level sensor 206 located in fuel tank 20 may provide an indication of the fuel level ("Fuel Level Input") to controller 12. As depicted, fuel level sensor 206 may comprise a float connected to a variable resistor. Alternatively, other types of fuel level sensors may be used. Fuel tank 20 may further include a fuel pump 207 for pumping fuel to injector 66.

Fuel tank 20 receives fuel via a refueling line 215, which acts as a passageway between the fuel tank 20 and a refueling door 229 on an outer body of the vehicle. During a fuel tank refueling event, fuel may be pumped into the vehicle from an external source through the refueling door. During a refueling event, isolation valve 110 may be opened to allow refueling vapors to be directed to, and stored in, canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake.

An optional canister check valve may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 218 coupled to intake manifold 44, and communicated with controller 12. Alternatively, MAP may be inferred from alternate engine operating conditions, such as mass air flow (MAF), as measured by a MAF sensor (not shown) coupled to the intake manifold. The check valve may be positioned between the canister purge valve and the intake manifold, or may be positioned before the purge valve.

Canister 22 may communicate with the atmosphere through vent 27. An evaporative leak check module 140 configured for detecting leaks in fuel system 200 may be located in vent 27. In particular, ELCM 140 is coupled in vent 27, between canister 22 and the atmosphere. ELCM 140 includes a vacuum pump 202. Vacuum pump 202 may be an electrically-operated vacuum pump driven by an on-board energy storage device (such as battery 52 of FIG. 1). Vacuum drawn by the pump may be delivered to the fuel system via a reference orifice 204. In one example, the reference orifice has a size of 0.017". ELCM 140 further includes a pressure sensor 206 for monitoring a change in fuel system pressure upon applying a vacuum during leak detection routines. It will be appreciated, however, that during leak detection, fuel system pressure may additionally or alternatively be estimated by a fuel system pressure sensor coupled in conduit 31. This may include, for example, a pressure sensor coupled to fuel tank 20, a pressure sensor coupled between fuel tank 20 and isolation valve 110, a pressure sensor coupled to canister 22, or a pressure sensor coupled between canister 22 and isolation valve 110.

To enable ELCM to detect leaks on both a canister side 224 of the fuel system as well as a fuel tank side 226 of the fuel system, as well as to distinguish between a fuel system leak on a fuel tank side relative to a canister side, ELCM 140 may be coupled to each of canister 22 and fuel tank 20 via switching valve 142. In the depicted example, switching valve 142 is configured as a three-way valve having passages 210 and 212 and a door that can be shifted between a first position (as shown by solid line 214) or a second position (as shown by dotted line 216) to divert flow through either passage 210 or passage 212. By adjusting the position of the door, a position of the switching valve may be adjusted so as to couple vacuum from ELCM 140 directly with the fuel tank or the canister. For example, switching valve 142 may be operated in a first position with the door at first position 214 wherein communication between ELCM 140 and fuel tank 20 via passage 210 is blocked and direct communication between ELCM 140 and canister 22 via passage 212 is enabled. This may be the position used during fuel vapor storing, purging, and during canister side leak detection. As another example, switching valve 142 may be operated in a second position with the door at second position 216 wherein communication between ELCM 140 and fuel tank 20 via passage 210 is enabled and direct communication between ELCM 140 and canister 22 via passage 212 is blocked. In one example, the first position may be a default position of the switching valve. That is, switching valve 142 may be configured to be normally in first position 214, with passage 212 open and the valve may be selectively shifted to second position 216 to selectively close passage 212 and open passage 210 when fuel tank side leak detection is performed. With the switching valve in the first position, during fuel vapor storing operations (for example, during fuel tank refueling and while the engine is not running), air stripped of fuel vapor after having passed through the canister, can be pushed out to the atmosphere through passage 212. Likewise, during purging operations (for example, during canister regeneration and while the engine is running), fresh air may be received from the atmosphere along passage 212 to strip the fuel vapors stored in the canister. As such, during fuel vapor storing or purging operations, vacuum pump 202 is not operated.

Figure 4:
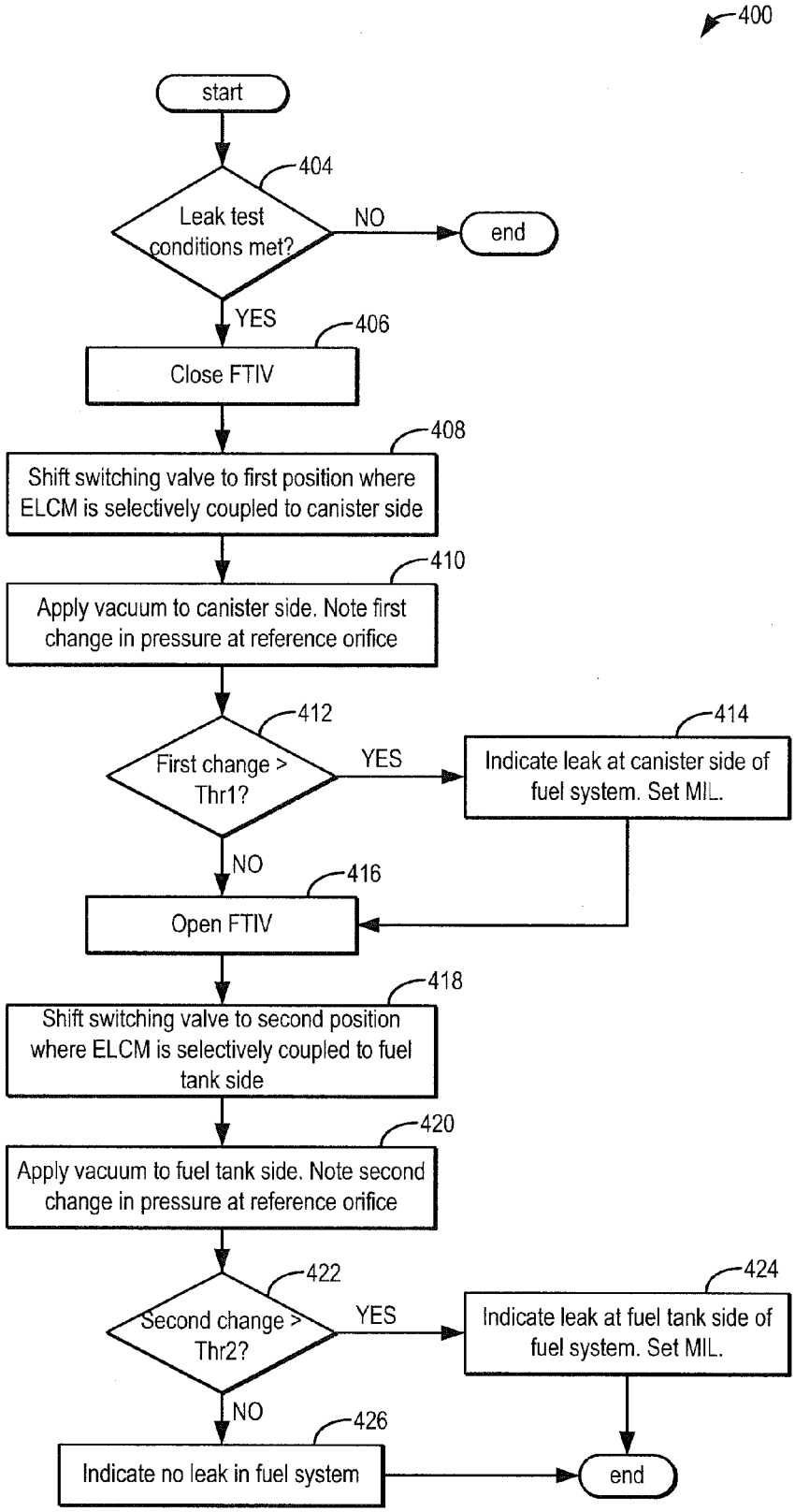
FIG. 4 shows a high level flow chart for diagnosing fuel system integrity on each of a canister side and fuel tank side of a fuel system.

As elaborated at FIG. 4, during leak detection routines, the position of switching valve 142 may be adjusted and vacuum pump 202 may be operated to apply vacuum on either a canister side or fuel tank side of the fuel system. Once a threshold vacuum level is reached, vacuum pump operation may be discontinued and a change in fuel system pressure may be monitored at the reference orifice 204. For example, a change in pressure may be monitored by pressure sensor 206. Based on the change in pressure relative to a threshold, fuel system leaks may be determined. For example, to detect leaks on the canister side of the fuel system, the vacuum pump may be operated with the switching valve in first position 214 and with isolation valve 110 closed. During this condition, vacuum is applied directly from the ELCM onto canister side 224 and a leak on the canister side may be identified based on a subsequent change in fuel system pressure. In comparison, to detect leaks on the fuel tank side of the fuel system, the vacuum pump may be operated with the switching valve in second position 216 and with isolation valve 110 open. During this condition, vacuum is applied directly from the ELCM onto fuel tank side 226 and a leak on the fuel tank side may be identified based on a subsequent change in fuel system pressure.

It will be appreciated that while FIG. 2 shows switching valve 142 as a three-way valve having a door diverting flow between passages 210 or 212, in alternate examples, switching valve 142 may be configured as a diverter valve.

FIG. 3 shows another example embodiment 300 of the fuel system of FIG. 1. Herein, the fuel system includes a latching valve 342 in place of three-way switching valve 142. Specifically, latching valve 342 is included in purge line 28 as close to canister 22 as possible. In one example, latching valve 342 may be directly mounted on canister 22. Latching valve 342 may be configured with a seal that is normally open and that is selectively closed when fuel tank side leak detection is performed. Herein, the leak detection routine would inherently assume that the canister side is leak-free.

Now turning to FIG. 4, an example method 400 for diagnosing leaks on different sides of a fuel system is shown. The method allows the same leak detection module (including a common vacuum pump and reference orifice) to be used for detecting leaks on both a canister and a fuel tank side of a fuel system.

At 404, it may be determined if leak test conditions have been met. Entry conditions for leak detection may include a variety of engine and/or fuel system operating conditions and parameters. Additionally, in the case when the engine is included in a hybrid electric vehicle, entry conditions for leak detection may include a variety of vehicle conditions.

For example, entry conditions for leak detection may include an amount of time since a prior leak testing. For example, leak testing may be performed on a set schedule, e.g. leak detection may be performed after a vehicle has traveled a certain amount of miles since a previous leak test or after a certain duration has passed since a previous leak test.

As another example, entry conditions for leak detection may include a temperature of one or more fuel system components being in a predetermined temperature range. For example, temperatures which are too hot or too cold may decrease accuracy of leakage detection. Such a temperature range may depend on the method used to calculate the leak detection and the sensors employed. However, in some examples, leak detection may occur at any temperature.

As another example, entry conditions for leak detection may include an amount of available energy stored, e.g., in an energy storage device (such as battery 52 of FIG. 1), to run a vacuum pump. Thus, it may be confirmed if the state of charge, voltage, etc. of the battery is such that sufficient energy is available to perform the leak test. Additionally entry conditions for leak detection may include whether or not a vehicle is in operation and the amount of power being drawn, e.g., amount of torque, engine RPM, etc. by the vehicle is less than a threshold value. For example, in the case of a hybrid vehicle, the vehicle may be in engine-off operation powered by the energy storage device. In this example, if there is a large draw of energy, e.g. in response to a large torque request, then, in some examples, leak detection may be postponed to reduce the power drawn from the battery for leak detection. Thus entry conditions for leak detection may be based on various operating conditions, such as speed, torque, etc., or whether auxiliary components, e.g., air conditioning, heat, or other processes, are using more than a threshold amount of stored energy.

As another example, entry conditions for leak detection may include a door opening. For example, leak detection may occur when a driver opens a door, e.g., indicating that the driver is about to leave the vehicle. As another example, entry conditions for leak detection may include a door closing, For example, leak detection may occur when a driver closes the door, e.g., potentially indicating that the car is about to be started. As another example, entry conditions for leak detection may include a key-off event, e.g., as performed by a driver of a vehicle. For example, leak detection may be performed following a key-off event. As another example, entry conditions for leak detection may include a key-on event, e.g., as performed by a driver of a vehicle. For example, leak detection may be performed immediately following a key-on event before the engine starts, or an engine may start in an engine-off mode and leak detection may be performed at each key-on and/or key-off event.

As another example, entry conditions for leak detection may be based on a vehicle operating mode change. For example, leak detection may be performed following a transition from engine-on mode to engine-off mode.

As another example, entry conditions for leak detection may include whether or not a leak has previously been detected. For example, if a leak was detected by a prior leak test, then leak testing may not be performed, e.g., until the leak is fixed and an onboard diagnostic system code has been reset.

As another example, entry conditions for leak detection may include if a refueling event is taking place. For example, leak detection may not be performed while the fuel tank is being refilled or when the fuel cap is off, etc.

If leak test conditions are confirmed, the routine includes, at 406, closing an isolation valve coupled between a fuel tank and a canister of the fuel system. By closing the isolation valve, the fuel tank is isolated from the rest of the fuel system. In addition to closing the FTIV, a canister vent valve (such as CVV 108) coupling the canister to the atmosphere may be closed. Furthermore, a canister purge valve (such as CPV 112) coupling the canister to the engine intake manifold may also be closed.

At 408, the routine includes, actuating a switching valve coupling a leak check module (such as ELCM 140) to the fuel system to a first position. The first position corresponds to a position where the ELCM is selectively coupled to the canister (or canister side of the fuel system) and not to the fuel tank (or fuel tank side of the fuel system). In one example, the first position may be a default position of the switching valve such that actuation is not required.

At 410, the routine includes applying vacuum to the canister side of the fuel system. Applying vacuum includes operating a battery-driven vacuum pump, such as vacuum pump included in the leak check module of the fuel system. For example, with the isolation valve closed, vacuum pump 202 of ELCM 140 may be operated. Since the switching valve is in the first position during this condition, where the fuel tank is isolated from the ELCM, the vacuum is selectively applied to only the canister side of the fuel system. Applying vacuum includes applying vacuum for a threshold duration or until a threshold fuel system vacuum level is reached. In one example, the fuel system vacuum level may be estimated by a pressure sensor coupled in the leak check module. Alternatively, the fuel system vacuum level may be estimated by a fuel system pressure sensor, such as a pressure sensor coupled in conduit 31, between FTIV 110 and canister 22.

At 412, the routine includes estimating a first change in pressure of the fuel system at the reference orifice (such as reference orifice 204 of FIGS. 2-3) and comparing it to a first threshold (Thr_1). The first threshold may be based on a threshold leak size for the canister side of the fuel system. Specifically, the first threshold may be based on the threshold leak size relative to a size of the reference orifice. As an example, the threshold leak size mandated on the canister side (that is, the leak orifice size that needs to be detected on the canister side for emissions compliance) may be 0.017". If the reference orifice has a size of 0.017", the first threshold may be set at 0.9. As another example, if the reference orifice size is 0.010" and the threshold leak size on the canister side is 0.017", the first threshold may be set at 0.5-0.6.

The controller may then indicate leakage on the canister side of the fuel system based on the first change in pressure at the reference orifice following applying of vacuum to the fuel system with the isolation valve closed. Specifically, at 414, the routine includes indicating leakage on the canister side of the fuel system based on the first change in pressure being higher than the first threshold. The controller may set a first diagnostic code or malfunction indication light (MIL) in response to the indication of canister leak. In one example, indicating leakage on the canister side includes indicating no leakage on the fuel tank side.

Upon completion the leak detection on the canister side, the routine proceeds to perform a leak detection on the fuel tank side. Specifically, at 416, the routine includes opening the isolation valve. While opening the FTIV, a canister purge valve (such as CPV 112) coupling the canister to the engine intake manifold may be maintained closed.

At 418, the routine includes, actuating the switching valve coupling the leak check module (such as ELCM 140) to the fuel system to a second position. The second position corresponds to a position where the ELCM is selectively coupled to the fuel tank (or fuel tank side of the fuel system) and not to the canister (or canister side of the fuel system).

At 420, the routine includes applying vacuum to the fuel tank side of the fuel system. Applying vacuum includes operating the battery-driven vacuum pump of the leak check module. For example, with the isolation valve closed, vacuum pump 202 of ELCM 140 may be operated. Since the switching valve is in the second position during this condition, where the canister is isolated from the ELCM, the vacuum is selectively applied to only the fuel tank side of the fuel system. Applying vacuum includes applying vacuum for a threshold duration or until a threshold fuel system vacuum level is reached. In one example, the fuel system vacuum level may be estimated by a pressure sensor coupled in the leak check module. Alternatively, the fuel system vacuum level may be estimated by a fuel system pressure sensor, such as a pressure sensor coupled in conduit 31, between FTIV 110 and fuel tank 20.

At 422, the routine includes estimating a second change in pressure of the fuel system at the reference orifice and comparing it to a second threshold (Thr_2). The second threshold may be based on a threshold leak size for the fuel tank side of the fuel system. Specifically, the second threshold may be based on the threshold leak size for the fuel tank side relative to a size of the reference orifice. As an example, the threshold leak size mandated on the fuel tank side (that is, the leak orifice size that needs to be detected on the fuel tank side for emissions compliance) may be 0.010". If the reference orifice size is 0.010" and the threshold leak size on the canister side is 0.010", the second threshold may be set at 1.0. As another example, if the reference orifice has a size of 0.017", the second threshold may be set at a value higher (or lower) than 1.0. As such, the second threshold for the fuel tank side may be higher than the first threshold for the canister side so as to enable measurement of a smaller leak size on the fuel tank side.

The controller may then indicate leakage on the fuel tank side of the fuel system based on the second change in pressure at the reference orifice following applying of vacuum to the fuel system with the isolation valve open. Specifically, at 424, the routine includes indicating leakage on the fuel tank side of the fuel system based on the second change in pressure being higher than the second threshold. The controller may set a second diagnostic code or malfunction indication light (MIL) in response to the indication of fuel tank leak. In one example, indicating leakage on the fuel tank side includes indicating no leakage on the canister side.

In this way, a fuel system may be operated in a first mode with a switching valve in a first position to detect leakage on a first, canister side of the fuel system, and then operated in a second mode with the switching valve in a second position to detect leakage on a second, fuel tank side of the fuel system. The fuel system may include a fuel tank coupled to a canister via an isolation valve, and a switching valve located between canister and the atmosphere, the switching valve coupling each of the fuel tank and the canister to a leak check module including a vacuum pump and a reference orifice. An engine controller may be configured to distinguish fuel system degradation due to leakage on the first, canister side from fuel system degradation due to leakage on the second, fuel tank side of the fuel system based on a first change in fuel system pressure while operating in the first mode relative to a second change in fuel system pressure while operating in the second mode. Operating in the first mode may include operating with the isolation valve closed while operating in the second mode may include operating with the isolation valve open. Operating in the first mode may further include selectively applying vacuum from the vacuum pump to only the first, canister side of the fuel system and indicating leakage on the first side based on a first change in pressure at the reference orifice being higher than a first threshold. Likewise, operating in the second mode may further include selectively applying vacuum from the vacuum pump to only the second, fuel tank side of the fuel system and indicating leakage on the second side based on a second change in pressure at the reference orifice being higher than a second threshold. Herein, the first threshold may be based on a first threshold leak size to be detected on the canister side (relative to the size of the reference orifice) and the second threshold may be based on a second threshold leak size to be detected on the fuel tank side (relative to the size of the reference orifice). Further, the first threshold may be lower than the second threshold.

In this way, the same reference orifice and the same leak check module can be used to identify a larger leak on the canister side of a fuel system and a smaller leak on a fuel tank side of the fuel system. Further, a fuel system leak due to a canister side leak may be distinguished from a fuel system leak due to a fuel tank side leak.

Figure 5:
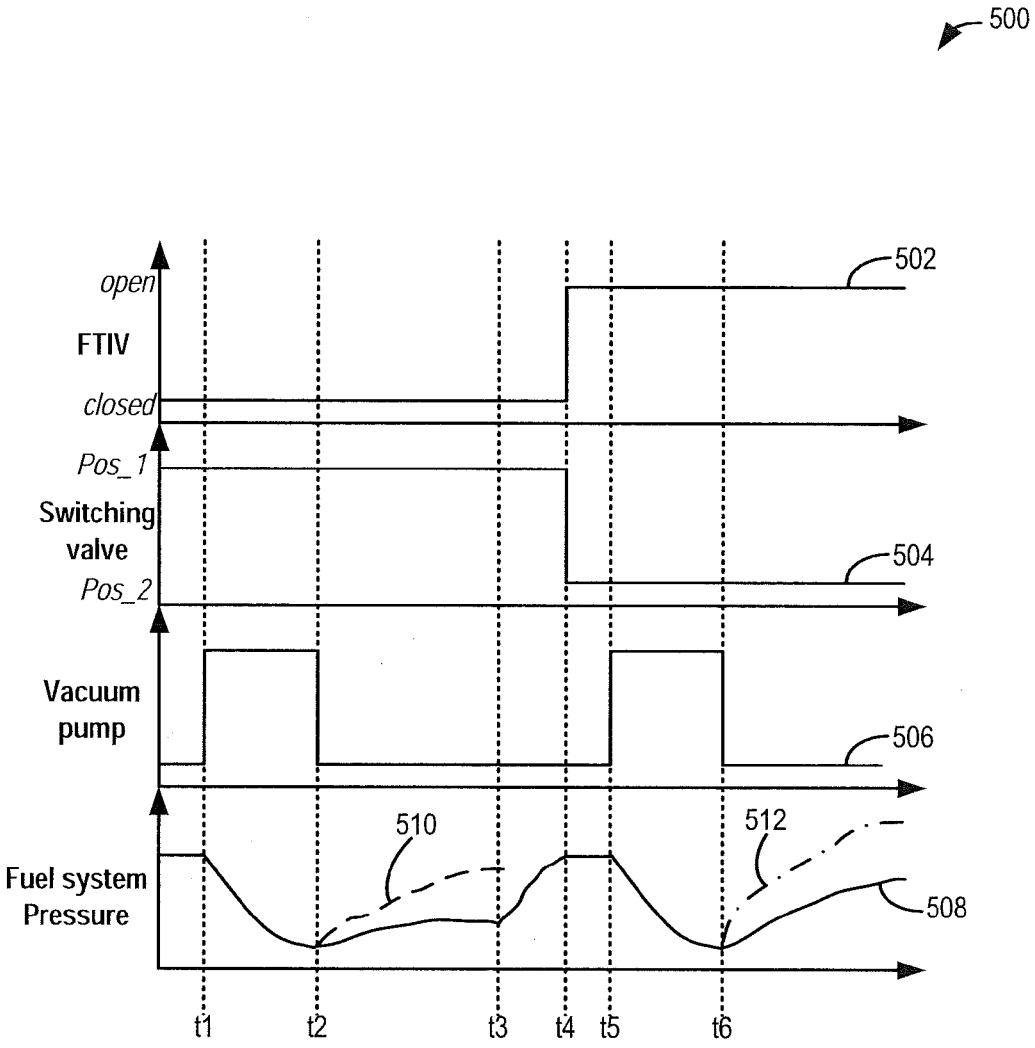
FIG. 5 shows example leak tests, according to the present disclosure.

Now turning to FIG. 5, an example leak test is shown at map 500. Specifically, map 500 depicts the position (open or closed) of a fuel tank isolation valve (FTIV) at plot 502, the position (first position Pos_1, or second position Pos_2) of a switching valve at plot 504, vacuum pump operation at plot 506, and fuel system pressure at plot 508.

Prior to t1, leak test conditions may not be met and the fuel system may be operating with the FTIV closed to keep diurnal vapors in the fuel tank (plot 502) and with the switching valve in the first, default position (Pos_1, plot 504). During this time, the vacuum pump is not operated (plot 506) and the fuel system pressure is maintained (plot 508). Herein, the fuel system pressure is estimated by a pressure sensor coupled to the leak check module.

At t1, leak test conditions are confirmed and a canister side leak detection operation is initiated. Specifically, while maintaining the FTIV open and the switching valve in the first position (where the fuel tank is isolated from the leak check module), a vacuum pump of the leak check module may be operated to apply vacuum on the canister side of the fuel system. As the vacuum pump is operated, the fuel system pressure may start to drop. The vacuum pump may be operated for a duration (from t1 to t2) until a target fuel system vacuum level is reached (at t2). At this point, once a threshold amount of vacuum has been applied to the fuel system, vacuum pump operation is disabled. Once the pump is disabled, the fuel system pressure may start to bleed-up towards atmospheric pressure via pressure dissipation at the reference orifice. A first change in the fuel tank pressure following the application of the negative pressure is monitored between t2 and t3. In the depicted example, a rate of bleed-up of fuel tank pressure (towards atmospheric pressure) is monitored. In the absence of a leak on the canister side of the fuel system, the fuel tank pressure may bleed up at a slower rate (e.g., slower than a first threshold rate), and stabilize at a lower pressure value (e.g., at or below a first reference value), as shown by graph 508 (solid line). However, in the presence of a leak on the canister side of the fuel system, the pressure may bleed up at a faster rate (e.g., faster than the first threshold rate), and stabilize at a higher pressure value (e.g., above the first reference value), as shown by graph 510 (dashed line). In response to a leak being detected, fuel system degradation on the canister side is indicated by setting a first diagnostic code.

Following leak detection on the canister side, the fuel system pressure is allowed to stabilize (between t3 and t4) and then leak detection on the fuel tank side is initiated at t4. Specifically, at t4, the FTIV is closed and the switching valve is shifted to a second position (where the fuel tank is directly coupled to the leak check module). At t5, the vacuum pump of the leak check module is operated to apply vacuum on the fuel tank side of the fuel system. As the vacuum pump is operated, the fuel system pressure may start to drop. The vacuum pump may be operated for a duration (from t4 to t5) until a target fuel system vacuum level is reached (at t5). At this point, once a threshold amount of vacuum has been applied to the fuel system, vacuum pump operation is disabled. Once the pump is disabled, the fuel system pressure may start to bleed-up towards atmospheric pressure via pressure dissipation at the reference orifice. A second change in the fuel tank pressure following the application of the negative pressure is monitored between t5 and t6. In the depicted example, a rate of bleed-up of fuel tank pressure (towards atmospheric pressure) is monitored. In the absence of a leak on the fuel tank side of the fuel system, the fuel tank pressure may bleed up at a slower rate (e.g., slower than a second threshold rate), and stabilize at a lower pressure value (e.g., at or below a second reference value), as shown by graph 508 (solid line). However, in the presence of a leak on the canister side of the fuel system, the pressure may bleed up at a faster rate (e.g., faster than the second threshold rate), and stabilize at a higher pressure value (e.g., above the second reference value), as shown by graph 512 (dashed and dotted line). Herein, the second threshold rate and second reference value used on the fuel tank side is higher than the first threshold rate and first reference value used on the canister side so as to enable detection of a smaller leak size on the fuel tank side as compared to the canister side. In response to a leak being detected, fuel system degradation on the fuel tank side is indicated by setting a second diagnostic code.

In one example, a fuel system in a hybrid electric vehicle system includes an engine; a fuel tank; a canister for storing fuel vapors; an isolation valve coupled in a vapor line between the fuel tank and the canister; a leak check module including a reference orifice, a vacuum pump, and a pressure sensor; and a switching valve coupled along a vent of the canister, the switching valve selectively couplable to the fuel tank or the canister. The vehicle system may include a controller with computer readable instructions for: in response to leak detection conditions being met, closing the isolation valve; actuating the switching valve to a first position to selectively couple the leak check module to the canister; operating the vacuum pump to apply vacuum to the canister; and indicating a canister leak based on a first change in pressure at the reference orifice following the applying of vacuum being larger than a first threshold. The controller may include further instructions for: opening the isolation valve; shifting the switching valve to a second position to selectively couple the leak check module to the fuel tank; operating the vacuum pump to apply vacuum to the fuel tank; and indicating a fuel tank leak based on a second change in pressure at the reference orifice following the applying of vacuum being larger than a second threshold. The controller may then set a first diagnostic code in response to the indication of canister leak; and set a second diagnostic code in response to the indication of fuel tank leak.

In this way, a leak check module may be selectively coupled to one of a fuel tank side or a canister side of a fuel system to diagnose each side independent of the other side. By coupling a three-way switching valve into a fuel system, between a fuel vapor canister and the leak check module, wherein the switching valve is also plumbed into the vapor line between a fuel tank and an isolation valve, vacuum may be directly applied to either an isolated canister or an isolated fuel tank. This allows each of a canister side and fuel tank side of the fuel system to be assessed for leaks independent of the other side using the same leak check module and reference orifice. By monitoring a change in pressure at a reference orifice following the applying of vacuum, fuel system leaks can be identified. By comparing the change in pressure on the canister side to threshold that is different from the threshold applied for the change in pressure on the fuel tank side, leaks of different sizes may be identified on either side. For example, smaller leaks on the fuel tank side may be reliably detected while also detecting larger leaks on the canister side. Overall, emissions compliance is improved.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

indicating leakage on a canister side of a fuel system based on a first change in pressure at a reference orifice following applying of vacuum to the fuel system by operating a vacuum pump with an isolation valve closed; and indicating leakage on a fuel tank side of the fuel system based on a second change in pressure at the reference orifice following applying of vacuum to the fuel system with the isolation valve open, an inlet of the pump coupled to the fuel system via a three-way switching valve, where in a first valve position the pump inlet coupled directly to the canister while the isolation valve is closed, and in a second valve position the pump inlet is coupled directly to the tank with the isolation valve open, the change in pressure detected by at least a fuel system pressure sensor.

2. The method of claim 1, wherein the isolation valve is coupled between a fuel tank and a canister of the fuel system.

3. The method of claim 2, wherein indicating leakage on the canister side based on the first change in pressure includes indicating no leakage on the fuel tank side.

4. The method of claim 2, wherein indicating leakage on the fuel tank side based on the second change in pressure includes indicating no leakage on the canister side.

5. The method of claim 2, wherein indicating leakage based on the first change in pressure includes indicating leakage based on the first change in pressure being larger than a first threshold, the first threshold based on a first threshold leak size on the canister side relative to the reference orifice.

6. The method of claim 5, wherein indicating leakage based on the second change in pressure includes indicating leakage based on the second change in pressure being larger than a second threshold, the second threshold based on a second threshold leak size on the fuel tank side relative to the reference orifice.

7. The method of claim 6, wherein the second threshold leak size on the fuel tank side is smaller than the first threshold leak size on the canister side, and wherein the second threshold is higher than the first threshold.

8. The method of claim 6, wherein the vacuum pump and the reference orifice are included in a leak check module of the fuel system, the leak check module coupled to the fuel system via the switching valve, the switching valve coupled between the canister and atmosphere and the fuel tank and atmosphere.

9. The method of claim 8, wherein indicating leakage based on the first change includes actuating the switching valve to a first position and wherein indicating leakage based on the second change includes actuating the switching valve to a second, different position.

10. The method of claim 9, wherein when the switching valve is actuated to the first position, vacuum is applied from the vacuum pump directly to the fuel tank, and wherein when the switching valve is actuated to the second position, vacuum is applied from the vacuum pump directly to the canister.

11. A method for monitoring and operating a fuel system coupled to an engine, comprising:

operating in a first mode with a switching valve in a first position to detect leakage on a first, canister side of the fuel system with vacuum applied from a vacuum pump directly to the fuel tank; and operating in a second mode with the switching valve in a second position to detect leakage on a second, fuel tank side of the fuel system, with vacuum applied from the vacuum pump directly to the canister, the fuel tank coupled to the canister on the tank side, the canister communicating with atmosphere on the first side.

12. The method of claim 11, further comprising distinguishing fuel system degradation due to leakage on the first, canister side from fuel system degradation due to leakage on the second, fuel tank side of the fuel system based on a first change in fuel system pressure while operating in the first mode relative to a second change in fuel system pressure while operating in the second mode.

13. The method of claim 12, wherein the fuel system includes a fuel tank coupled to a canister via an isolation valve, and wherein the switching valve is a three-way valve located between the fuel tank and the isolation valve, the switching valve coupling each of the fuel tank and the canister directly to a leak check module including the vacuum pump and a reference orifice, the three-way valve coupled directly to the fuel tank in a first passage between the isolation valve and the tank in a first position, and coupled directly to the canister in a second passage separate and upstream of the first passage, the second passage connected coupling the three-way valve to the canister.

14. The method of claim 13, wherein operating in the first mode further includes operating with the isolation valve closed and wherein operating in the second mode further includes operating with the isolation valve open.

15. The method of claim 14, wherein operating in the first mode further includes selectively applying vacuum from the vacuum pump to only the first, canister side of the fuel system and indicating leakage on the first side based on the first change in pressure at the reference orifice being higher than a first threshold, and wherein operating in the second mode further includes selectively applying vacuum from the vacuum pump to only the second, fuel tank side of the fuel system and indicating leakage on the second side based on the second change in pressure at the reference orifice being higher than a second threshold.

16. The method of claim 15, wherein the first threshold is based on a first threshold leak size to be detected on the canister side and the second threshold is based on a second threshold leak size to be detected on the fuel tank side, and wherein the first threshold is lower than the second threshold.

17. A fuel system, comprising:

an engine;

a fuel tank;

a canister for storing fuel vapors;

an isolation valve coupled in a vapor line between the fuel tank and the canister;

a leak check module including a reference orifice, a vacuum pump, and a pressure sensor;

a three-way switching valve coupled to each of a vent of the canister and a separate conduit from the canister, the switching valve selectively couplable directly to the fuel tank and the canister via the conduit and vent, respectively; and a controller with computer readable instructions for:

in response to leak detection conditions being met, closing the isolation valve;

actuating the switching valve to a first position to selectively couple the leak check module to the canister;

operating the vacuum pump to apply vacuum to the canister; and indicating a canister leak but not a fuel tank leak based on a first change in pressure at the reference orifice following the applying of vacuum being larger than a first threshold.

18. The fuel system of claim 17, wherein the controller includes further instructions for:

opening the isolation valve;

shifting the switching valve to a second position to selectively couple the leak check module to the fuel tank;

operating the vacuum pump to apply vacuum to the fuel tank; and indicating a fuel tank leak but not a canister leak based on a second change in pressure at the reference orifice following the applying of vacuum being larger than a second threshold.

19. The fuel system of claim 18, wherein the controller includes further instructions for:

setting a first diagnostic code in response to the indication of canister leak; and setting a second diagnostic code in response to the indication of fuel tank leak.

* * * * *